United States Patent [19]

Salzer

[11] 4,001,748

[45] Jan. 4, 1977

[54] ELECTRIC FUSE HAVING HELICALLY WOUND FUSIBLE ELEMENT AND PROCESS FOR MANUFACTURING THE FUSE

[75] Inventor: Erwin Salzer, Waban, Mass.

[73] Assignee: The Chase-Shawmut Company, Newburyport, Mass.

[22] Filed: July 10, 1975

[21] Appl. No.: 594,863

[52] U.S. Cl. ..... 337/159; 337/252

[51] Int. Cl.[2] ..... H01H 85/04

[58] Field of Search ..... 337/159, 158, 251, 252, 337/231, 190, 218; 29/623

[56] References Cited

UNITED STATES PATENTS

| | | | |
|---|---|---|---|
| 3,333,336 | 8/1967 | Cameron et al. | 29/623 |
| 3,680,019 | 7/1972 | Kozacka | 337/161 |
| 3,831,126 | 8/1974 | Wakui | 337/251 |
| 3,848,214 | 11/1974 | Salzer | 29/623 |
| 3,866,318 | 2/1975 | Kozacka | 29/623 |

*Primary Examiner*—Harold Broome

[57] ABSTRACT

A fuse for elevated circuit voltages having a fusible element that is substantially in the shape of a helix and is, in essence, supported only by the pulverulent arc-quenching filler of the fuse, i.e. which is supported without resort to a mandrel of electric insulating material around which the fusible element is wound. The casing of the fuse is sealed to preclude the escape of hot arc products by circular disks of asbestos fibers and by ferrules mounted on the ends of the casing. Plug terminals performing that sealing function are dispensed with. The steps involved in assembling the fuse are described in detail.

5 Claims, 11 Drawing Figures

ELECTRIC FUSE HAVING HELICALLY WOUND FUSIBLE ELEMENT AND PROCESS FOR MANUFACTURING THE FUSE

BACKGROUND OF THE INVENTION

Electric fuses whose voltage rating is relatively high call for fusible elements whose length exceeds that of the casing or fuse tube and which are wound substantially in the shape of a helix. In instances where the dimensional stability of helically wound fusible elements is relatively high, special supports of electric insulating material for the helically wound fusible elements may be dispensed with. Typical fuses of this nature are disclosed in U.S. Pat. No. 3,571,775 to F. J. Kozacka et al; 03/23/71 for HIGH-VOLTAGE FUSE HAVING A PLURALITY OF HELICALLY WOUND RIBBON FUSE LINKS. Many situations call for extremely thin fusible elements in ribbon form that have minimal dimensional stability. It is common practice in situations of this nature to provide mandrel-like supports of electric insulating material for the fusible elements around which the latter are wound helically. Typical fuses of this nature are disclosed in U.S. Pat. No. 3,680,019 to F. J. Kozacka; 07/25/72 for HIGH-VOLTAGE FUSE HAVING A PLURALITY OF FUSE LINKS WOUND HELICALLY AROUND AN INSULATING MANDREL. The presence of mandrel-like supports for helically wound fusible elements raises serious problems. All other conditions remaining unchanged, the presence of supporting mandrels for helically wound fusible elements drastically reduces the volume within the casing, or fuse tube, that is available for pulverulent arc-quenching filler. Another limitation resulting from the presence of mandrel-like supports for helically wound fusible elements are the cost of suitable mandrel materials. A desirable support material is high-grade alumina, the cost of which is high. The presence of mandrel-like supports for helically wound fusible elements gives rise to leakage current problems. Leakage currents may arise following a successful interruption of a faulted circuit by a fuse because the mandrel structure may become more or less conductive under the action of the arc. Mandrel-like supports for helically wound fusible elements which evolve gases when subjected to electric arcs contribute to successful interruption within given current ranges, but tend to result in other fault current ranges in the generation of very high internal pressures which impose unduly high demands on the dynamic bursting strength of casings, or fuse tubes.

U.S. Pat. No. 3,848,214 to E. Salzer; 11/12/74 for METHOD OF ASSEMBLING ELECTRIC HIGH-VOLTAGE FUSES AND SUBASSEMBLY THEREFOR discloses fuses having helically wound fusible elements that may be formed by narrow, extremely thin strips of metal, whose dimensional stability is minimal and which fuses do not require any mandrel-like structure of electric insulating material for the supporting of their fusible elements. The fuses disclosed in the above patent and their manufacture are predicated on the presence of plug terminals. This is an undesirable limitation in cases where the fuses are intended to be used in connection with fuse holders having contacts designed to cooperate with ferrules or terminal caps mounted on the outer surface of the casing or fuse tube.

The present invention relates to fuses having ferrules or terminal caps that are conductively interconnected by helically wound fusible elements, which elements are not required to be dimensionally stable, and not required to be supported by a mandrel-like supporting structure of electric insulating material.

SUMMARY OF THE INVENTION

Fuses embodying this invention include a tubular casing of electric insulating material, a pulverulent arc-quenching filler inside said casing and a substantially helically wound fusible element inside said casing embedded in said filler. The fuses further include means for closing the casing and for precluding the escape of products of arcing therefrom. One of a pair of ferrules is mounted on each of the axially outer ends of said casing. One of a pair of spiders of sheet metal is arranged in abutting relation against each of the pair of rims formed by the ends of said casing. Each of said pair of spiders has tabs arranged between the outer surface of said casing and the inner surface of one of said pair of ferrules and conductively connected to one of said pair of ferrules. One of said pair of spiders has a plurality of relatively small bores arranged relatively remote from the center region thereof, and one of said pair of spiders has a relatively large aperture in the center region thereof. Fuses embodying this invention further include a pair of washer-like metal disks conductively interconnected by said fusible element, and each affixed to the axially inner surface of said center region of one of said pair of spiders. Each of said pair of disks has a plurality of relatively small bores arranged in registry with said relatively small bores in said one of said pair of spiders. At least one of said pair of disks further has a relatively large aperture in the center region thereof in registry with said relatively large aperture in said one of said pair of spiders. The fit of each of said pair of disks inside said casing is so loose and the thickness thereof so small as not to inhibit the escape of products of arcing from said casing.

DESCRIPTION OF PREFERRED EMBODIMENT

Figure 1A:
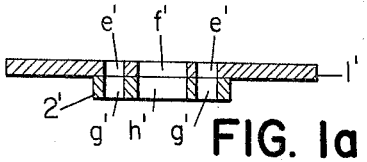
FIG. 1*a* is a cross-section along 1*a*—1*a* of a first composite spider-and-washer structure forming part of fuses embodying this invention.
Figure 1B:
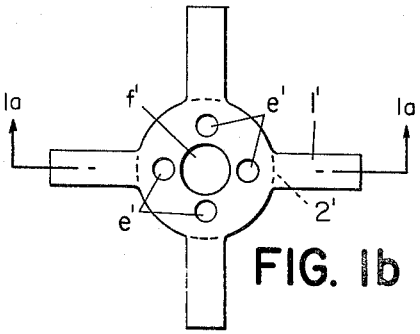
FIG. 1*b* is a top plan view of the structure of FIG. 1*a;*

In FIGS. 1*a*—1*d* reference characters 1′ and 1″ have been applied to indicate a pair of spiders each having four radial extensions or tabs. Spiders 1′ and 1″ are of relatively thin sheet metal, e.g. copper, and the radial extensions or tabs thereof may readily be bent. Spider 1′ has a plurality of bores *e′* which have a relatively small diameter and are arranged relatively remote from the center region of spider 1′. Spider 1′ is further provided with a circular aperture *f′* at the center region thereof which aperture has a relatively large diameter, i.e. a diameter considerably larger than that of bores *e′*. Reference characters 2′ and 2″ have been applied to indicate a pair of washer-like metal disks each affixed to the axially inner surface of one of sheet metal spiders 1′, 1″. Parts 2′ and 2″ are affixed to the center regions of spiders 1′, 1″ and conductively connected to the latter, preferably by spot welds (not shown). Disks 2′ and 2″ have a plurality of relatively small bores *g′* and *g″*, respectively. Bores *e′*, *g′* and *g″* are arranged in registry and bores *g″* are internally screw-threaded. Disk 2′ has a relatively large aperture *h′* in the center region thereof.

Figure 2A:
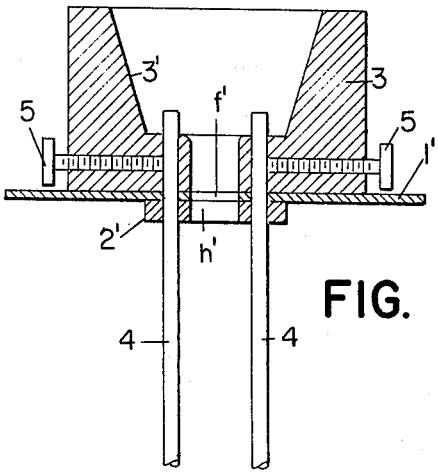
FIG. 2*a* shows the composite spider-and-washer structure of FIG. 1*a* in the same fashion as FIG. 1*a* with some parts added to it and is a section along 2*a*—2*a* of FIG. 2*b;*
Figure 1C:
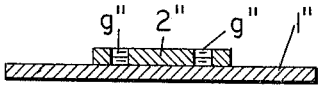
FIG. 1*c* is a cross-section along 1*c*—1*c* of FIG. 1*d* of a second composite spider-and-washer structure forming part of fuses embodying this invention.
Figure 1D:
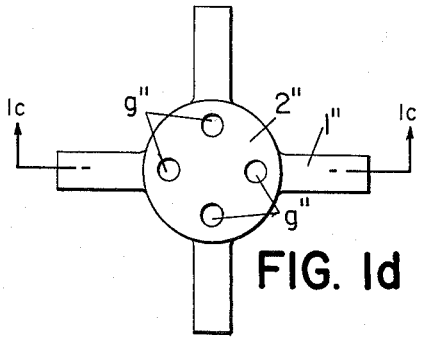
FIG. 1*d* is a top plan view of the structure of FIG. 1*c;*
Figure 2B:
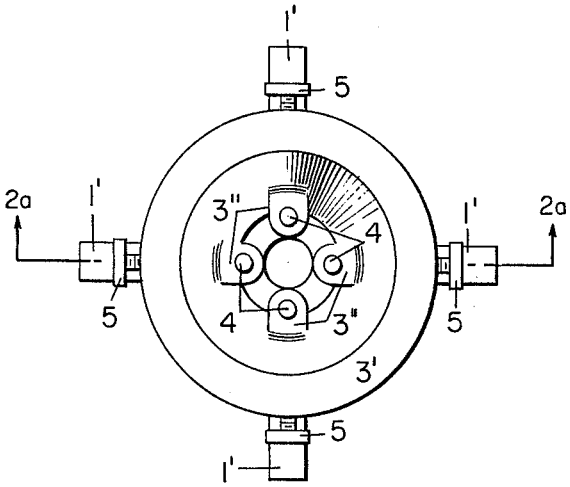
FIG. 2*b* is a top plan of the structure of FIG. 2*a;*

FIGS. 2*a* and 2*b* show, in addition to spider 1′ and washer 2′, a tubular funnel or abutment member 3 for spider 1′. The upper end of member 3 forms a funnel 3′, the narrow opening of which is arranged in registry with apertures *f′* and *h′* of spider 1′ and washer 2′. Member 3 is provided with four bosses 3″ of which each is provided with a bore parallel to, but radially spaced from, the axis of funnel surface 3′. A rod 4 of metal is inserted in each of the bores in bosses 3″. The four rods 4 may be engaged by set-screws 5, thus precluding relative movement between parts 3 and 4.

Figure 3:
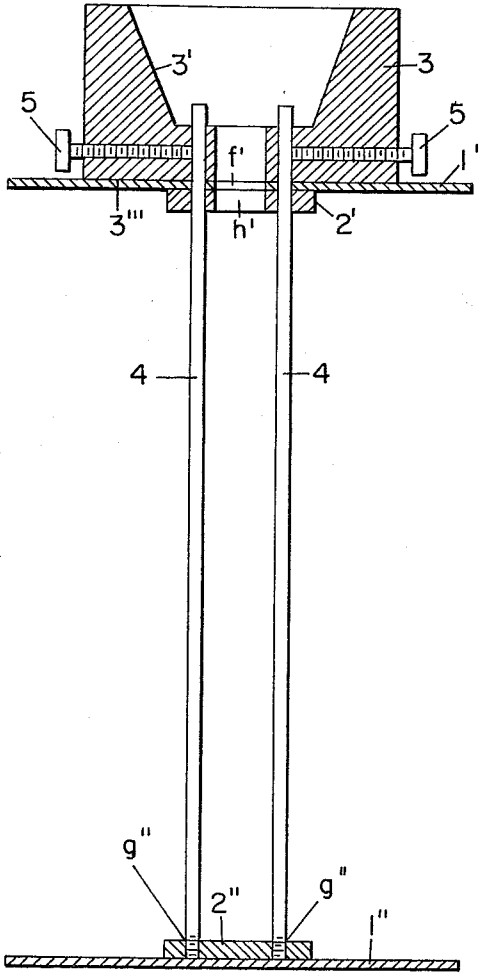

As shown in FIG. 3, rods 4 are firmly affixed to unit 1″, 2″ by screwing the lower screw-threaded ends of rods 4 into the internally screw-threaded bores *g″* of washers 2″. FIG. 3 further shows that abutment member 3 is clamped by set screws 5 against metal rods 4, thus limiting the movement of unit 1′, 2′ in one direction.

Figure 5:
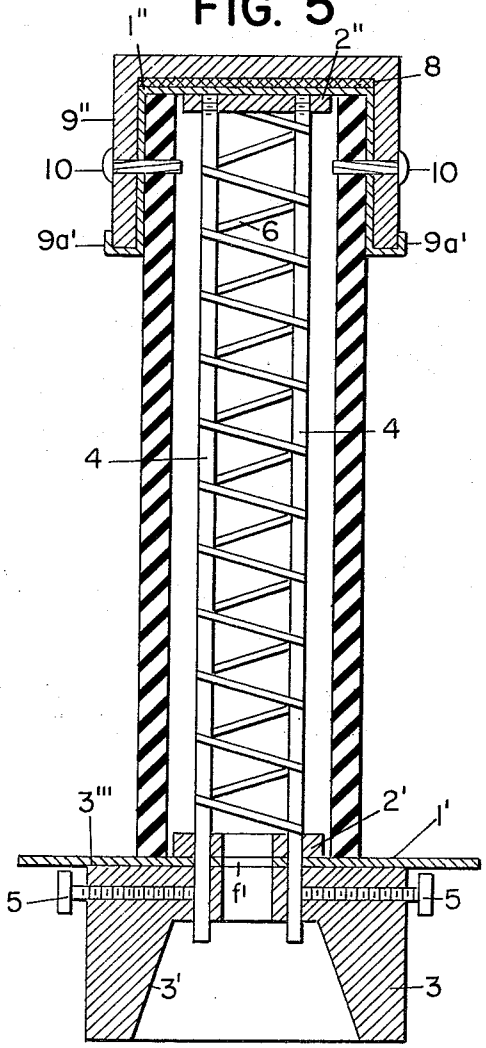
FIGS. 3–6 show mainly in longitudinal sections sequential stages or steps of the fuse assembly processes according to this invention.
Figure 4:
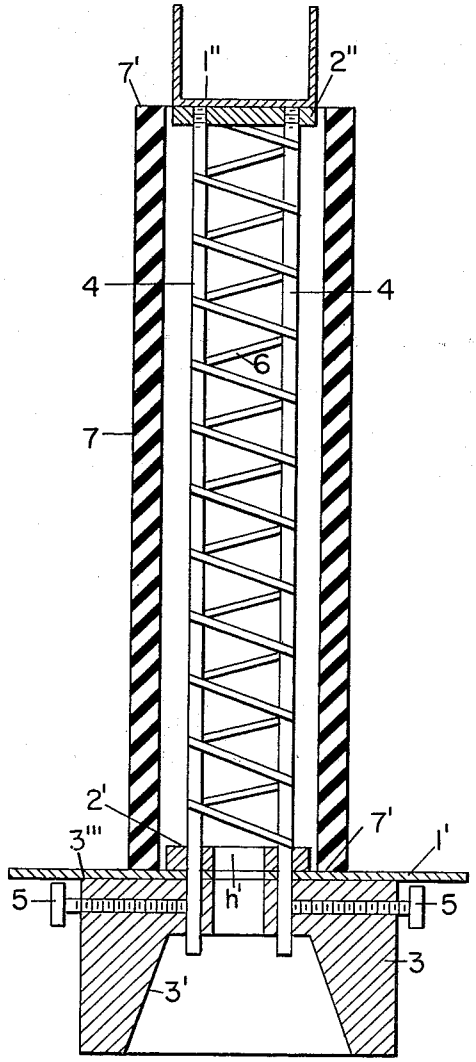

Thereupon the structure shown in FIG. 3 is reversed, as shown in FIG. 4, so that parts 1′, 2′ and 3 are at a relatively low level, and parts 1″ and 2″ at a relatively high level. In FIG. 4 reference character 6 has been applied to indicate a fusible element wound helically around the four rods 4 and conductively connected with the ends thereof to washers 2′ and 2″. This winding and connecting operation is performed after parts 1′, 2′, 3, 1″ and 2″ are in the reversed position shown in FIG. 4. In that position any relative movement of washers 2′ and 2″ is precluded. As shown in FIG. 4 the connector tabs of spider 1″ are bent upwardly 90° and this allows to slide a tubular casing or fuse tube 7 of electric insulating material into the position also shown in FIG. 4. In that position the lower rim 7′ of casing 7 abuts against spider 1′ which, in turn, abuts against the planar surface 3‴ of funnel or abutment member 3, and the upper rim 7′ of casing 7 is flush with the plane defined by the non-bent center region of spider 1″. Now the connector tabs of spider 1″ are bent over the upper rims 7′ of casing 7 into engagement with the outer surface of casing 1, a seal 8 of asbestos fibers is placed upon the center region of spider 1″, and a ferrule 9″ is mounted upon the upper end of casing 7 and pinned to casing 7 by means of drive screws 10. These operations are illustrated in FIG. 5. As also shown in FIG. 5, the ends of the connector tabs of spider 1″ may be turned around the axially inner rim of cap or ferrule 9″, and spot-welded to the latter at 9*a′*. Instead of conductively connecting the tabs of spider 1″ by spot welds to upper ferrule 9″ a good conductive connection may be established between parts 1″ and 9″ by an appropriate solder joint.

Figure 6:
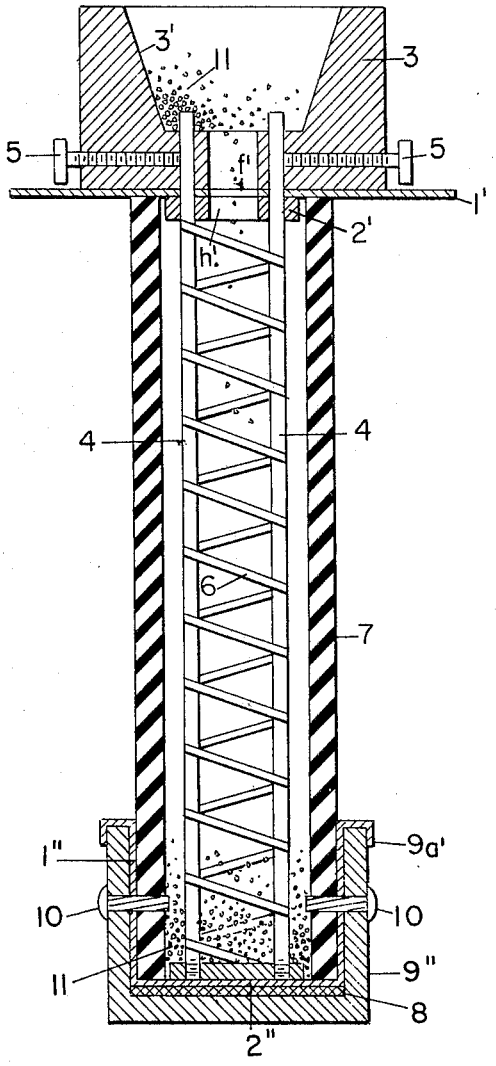
Figure 7:
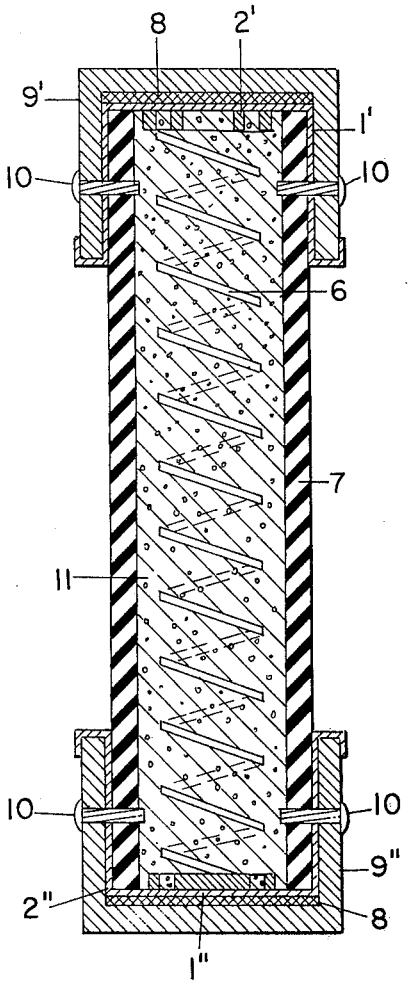
FIG. 7 is a diagrammatic representation of a completely assembled fuse embodying this invention showing the same in longitudinal section.

FIG. 6 shows the next steps in the process of assembling the fuse. These steps include a reversal of the constituent parts of the structure so that parts 1′, 2′ and 3 are positioned at a relatively high level and parts 1″, 2″ and 9″ at a relatively low level. Then a pulverulent arc-quenching filler 11 is filled through funnel portion 3′ of member 3 and through apertures *g′*, *h′*, into casing 7. During the case filling process shown but diagrammatically in FIG. 6 the filler 11 is compacted in order to form a firm support for the helically wound fusible element 6 on rods 4. Compacting of the arc-quenching filler 11 is effected in a conventional fashion by tapping the lateral wall of casing 7, and by subjecting the structure of FIG. 6 to vibrations. When casing 7 has been thoroughly filled with arc-quenching filler 11, set screws 5 may be loosened, rods 4 screwed out of washer 2″ and individually sequentially withdrawn from casing 7 in a direction longitudinally thereof. After withdrawal of any particular rod 4 a small amount of pulverulent filler 11 is added to casing 7 through member 3 to compensate for the volume that has been vacated by the withdrawal of a rod 4. Rods 4 may also be withdrawn simultaneously upon having been screwed out of washer 2″. For withdrawing rods 4 simultaneously screws 5 are not loosened and rods 4 are lifted out of casing 7 by lifting member 3. Upon removal of rods 4 from casing 7 some filler 11 is added and then the connector tabs of spider 1′ are bent from their position shown in FIG. 6 downwardly to engage the outer surface of casing 7 as shown in FIG. 7. Thereafter casing 7 is covered by a sealing disk 8 of asbestos fibers, or a similar material, and ferrule or terminal cap 9′ is mounted on casing 7. Terminal cap 9′ is identical to terminal cap 9″ on the lower end of casing 7 and also pinned to casing 7 by drive screws 10. The connector tabs of upper spider 1′ may be bent around the axially inner rim or edge of upper ferrule 9′ and spot-welded to it to minimize the contact resistance between spider 1′ and ferrule or terminal cap 9′.

FIG. 7 shows a fuse embodying this invention upon completion of the assembly thereof.

It will be noted that the fuse shown in FIG. 7 and the assembly thereof are predicated on washer-like disks 2″ having internally screw-threaded holes *g″*, and on rods 4 that are externally screw-threaded to cooperate with holes *g″*. The screw-threading of washer-like disks 2″ and of rods 4 may be dispensed with by resorting to the fixture means disclosed in my co-pending U.S. Pat. application Ser. No. 574,542; filed 05/05/75 for METHOD AND FIXTURE FOR MANUFACTURING FUSES HAVING HELICALLY WOUND FUSIBLE ELEMENTS.

While in the drawing the fusible element 6 is embodied by a single ribbon of metal, it will be understood that it might be embodied by a plurality of such ribbons which are connected in parallel. It will also be understood that the fusible element 6 has been shown in a diagrammatic fashion inasmuch as in practice the fusible element 6 must have alternating points of relatively small cross-sectional area and of relatively large cross-sectional area to limit the rate of change of current incident to blowing of the fuse under major fault conditions. It will further be understood that fusible element 6 may be formed by one or more wires rather than one or more metal ribbons.

Comparing the above structure with that disclosed in the above referred-to U.S. Pat. No. 3,848,214, it will be apparent that in the latter the plug terminals seal the casing and prevent the pressure of products of arcing that prevails at the ends of the casing from acting upon the ferrules. The latter perform only the function of cooperating with the contacts of a fuse holder to allow insertion of the fuse into a circuit to be protected. In the above structure the ferrules 9', 9'' jointly with asbestos disks 8 perform the dual function of precluding the escape of products of arcing from the casing 7 of the fuse and of cooperating with the contacts of a fuse holder to allow insertion of the fuse into a circuit to be protected. The washer-like parts 2', 2'' are of relatively much smaller diameter and much smaller thickness than the plug terminals of the above referred-to U.S. Pat. No. 3,848,214. They are also much less expensive than these plug terminals since they involve much less metal, and they are much easier to mount since their fit may and should be extremely loose. In addition thereto parts 2', 2'' do not require any fasteners as, for instance, steel pins, for affixing the same to the casing structure, which fasteners are needed in the structure of U.S. Pat. No. 3,848,214.

I claim as my invention:

1. An electric fuse for elevated circuit voltages including a. a tubular casing of electric insulating material;

b. a pair of ferrules each mounted on the outside of one of the ends of said casing for precluding the escape of arc products from said casing;

c. a pulverulent arc-quenching filler inside said casing;

d. a substantially helically wound fusible element inside said casing embedded in said filler and supported substantially by said filler only in absence of any fusible element-supporting mandrel means;

e. a pair of spiders of sheet metal each arranged in abutting relation to one of the pair of rims formed by the ends of said casing, each of said pair of spiders having tabs arranged between the outer surface of said casing and the inner surface of one of said pair of ferrules and conductively connected to one of said pair of ferrules, one of said pair of spiders having a plurality of relatively small bores arranged relatively remote from the center regions thereof and one of said pair of spiders having a relatively large aperture at the center region thereof;

f. a pair of washer-like metal disks conductively interconnected by said fusible element and each affixed to the axially inner surface of said center region of one of said pair of spiders, each of said pair of disks having a plurality of relatively small bores arranged relatively remote from the center region thereof in registry with said relatively small bores in said one of said pair of spiders and one of said pair of disks having a relatively large aperture at the center region thereof in registry with said relatively large aperture in one of said pair of spiders; and g. the fit of each of said pair of disks inside said casing being so loose and the thickness of each of said pair of disks being so small as to allow the pressure of products of arcing prevailing at the ends of said casing to act against the end surfaces of said pair of ferrules.

2. An electric fuse as specified in claim 1 wherein each of said pair of washer-like metal disks is spot-welded to one of said pair of spiders.

3. A method of manufacturing electric fuses for elevated circuit voltages including the steps of a. forming a pair of spider-disk-units by affixing each of a pair of metal disks to a spider of sheet metal which includes connector tabs;

b. mounting said pair of spider-disk units in spaced relation on a plurality of parallel metal rods, and winding a fusible element substantially helically around said plurality of metal rods while maintaining said spider-disk units in fixed relation relative to said plurality of metal rods;

c. bending said connector tabs of said spider of one of said pair of spider-disk units into a position substantially parallel to said plurality of metal rods, sliding a tubular casing over said bent connector tabs of said spider of said one of said pair of spider-disk units, and causing engagement of one of the rims of said casing with said spider of said other of said pair of spider-disk units;

d. bending said connector tabs of said spider of said one of said pair of spider-disk units toward the outer surface of said casing and mounting a first ferrule on said casing over said connector tabs of said spider of said one of said pair of spider-disk units;

e. filling said casing with a pulverulent arc-quenching filler and withdrawing said plurality of metal rods from said casing; and thereafter f. mounting a second ferrule on said casing over said connector tabs of said spider of the other of said pair of spider-disk units.

4. A method as specified in claim 3 of manufacturing electric fuses for elevated circuit voltages including the steps of a. affixing a funnel member including a substantially planar surface to said plurality of metal rods in such a position that said planar surface of said funnel member abuts against said spider of one of said spider-disk units;

b. inverting said funnel member preparatory to sliding said tubular casing over said bent connector tabs of said spider of said one of said pair of spider-disk units; and c. arranging said first ferrule at a relatively low, and said funnel member at a relatively high, level preparatory to filling said casing through said funnel member with said pulverulent arc-quenching filler.

5. An electric fuse for elevated circuit voltages including a. a tubular casing of electric insulating material;

b. a pair of ferrules each mounted on the outside of one of the ends of said casing;

c. a pulverulent arc-quenching filler inside said casing;

d. a substantially helically wound fusible element inside said casing embedded in said filler and supported substantially by said filler only in the absence of any fusible-element-supporting mandrel means;

e. a pair of spiders of sheet metal each arranged in abutting relation to one of the pair of rims formed by the ends of said casing and each having tabs arranged between the outer surface of said casing and the inner surface of said pair of ferrules and conductively connected to one of said pair of ferrules;

f. one of said pair of spiders having a relatively large aperture in the center region thereof and a plurality of noninternally screw-threaded relatively small bores arranged relatively remote from the center region thereof;

g. the other of said pair of spiders lacking a relatively large aperture in the center region and a plurality of relatively small bores arranged relatively remote from the center region;

h. a pair of washer-like metal disks conductively interconnected by said fusible element and each spot-welded to the axially inner surface of one of said pair of spiders;

i. each of said pair of metal disks having a plurailty of small bores arranged relatively remote from the center region thereof in registry with said relatively small bores in said one of said pair of spiders;

j. one of said pair of metal disks having a relatively large aperture substantially in registry with said relatively large aperture in said one of said pair of spiders; and k. the fit of each of said pair of metal disks inside said casing being so loose and the thickness of each of said pair of disks being so small as to allow the pressure of products of arcing to act against the end surfaces of said pair of ferrules.

* * * * *